US007052031B2

(12) United States Patent
Gravolin

(10) Patent No.: US 7,052,031 B2
(45) Date of Patent: May 30, 2006

(54) ADJUSTABLE ELECTRICAL TELL TALE MODULAR UNIT AND EXTERNAL MONITOR

(76) Inventor: Dennis Ronald Gravolin, 271 River Street, Maclean, NSW 2463 (AU)

( * ) Notice: Subject to any disclaimer, the term of this patent is extended or adjusted under 35 U.S.C. 154(b) by 128 days.

(21) Appl. No.: 10/607,482

(22) Filed: Jun. 27, 2003

(65) Prior Publication Data

US 2004/0005811 A1 Jan. 8, 2004

Related U.S. Application Data

(63) Continuation-in-part of application No. 10/428,157, filed on May 2, 2003, now abandoned.

(51) Int. Cl.
*G08B 21/18* (2006.01)

(52) U.S. Cl. ..... 280/422; 307/10.8; 340/458

(58) Field of Classification Search ..... 280/422; 307/10.8; 340/458
See application file for complete search history.

(56) References Cited

U.S. PATENT DOCUMENTS 4,005,313 A * 1/1977 Tibbits ..... 280/422
5,397,924 A * 3/1995 Gee et al. ..... 280/422
6,218,952 B1 * 4/2001 Borland et al. ..... 340/641

* cited by examiner

*Primary Examiner*—Renee Luebke
(74) *Attorney, Agent, or Firm*—Shlesinger, Arkwright & Garvey LLP

(57) ABSTRACT

An electrical tell tale system comprises a main control unit forming part of a trailer connector. The main control unit is a moulded module or cut printed circuit board, which fits into the connector. The main control unit has aligned pin connections to connect to and monitor all of the existing connections in the connector. The main control unit module includes screw type connections for the wiring from the vehicle harness and a tell tale monitor. The main control unit module is housed in the connector and by its connections changes the normal operation of the trailer connector to monitor all of its housed circuit connection in one complete unit.

5 Claims, 9 Drawing Sheets

ADJUSTABLE ELECTRICAL TELL TALE MODULAR UNIT AND EXTERNAL MONITOR

This is a continuation-in-part of application Ser. No. 10/428,157, filed May 2, 2003, now abandoned, incorporated herein by reference, which claims the priority benefit of Australian Patent No. 40593/02, filed May 13, 2002, hereby incorporated by reference.

BACKGROUND OF THE INVENTION

The Electrical Tell Tale System for Trailers, Australian Patent No. 833898, and U.S. Pat. No. 6,535,113, is a device which monitors the electrical systems of trailers and communicates to the driver of a hauling vehicle if those trailer circuits are operating correctly or are malfunctioning. The Electrical Tell Tale System consists of a main control unit which is mounted at the rear of the vehicle and wired in series with each trailer circuit. From the main control unit is a modular cable which runs to the instrument panel of the vehicle and at this end of the cable is the tell tale monitor which houses a number of light emitting diodes. The light emitting diodes indicate to the driver whether the trailer circuits are functioning correctly.

SUMMARY OF THE PRESENT INVENTION

The addition to the original invention is based on the main control unit and its casing, connections, electronics, and tell tale monitor. The electronics of the original invention are now formed in specific molded and designed "modules" or printed circuit boards (PCBs) which are able to be housed and fitted in any type of common trailer connector, including male, female connectors and adapters. This design forms a new generation trailer connector with an Electrical Tell Tale Safety System combined. Furthermore there has been additions to the electronics of the main control unit in order for the original current sensing switch to become adjustable to differing current loads making it adaptable to light emitting diode (LED) automotive lamps. Finally, an external monitor has been developed in order to be mounted on a caravan or trailer in order for the driver to see it and any people outside the vehicle, indicating the electrical safety state of the caravan or trailer.

With reference to the original invention, the main control unit was housed in an epoxy filled plastic housing which has two leads coming out either side, and these leads where distributed into connectors to connect the main control unit to the trailer wiring loom of the vehicle. With the addition, the main control unit is now placed at the end of the vehicle trailer wiring harness, actually inside the trailer connector. It can be adjusted to suit different trailer lamp combinations, such as LED lights and an external tell tale monitor has been developed to be used with the new concepts, however, the internal tell tale monitor as in the original patent is fully adaptable and vice versa.

The main control unit electronic components, and their main connections are epoxy molded in modules or printed circuit boards which can be a number of differing cut or molded shapes, specific to common trailer connector types. The main connections of the main control unit protrude from the module and are aligned for exact and accurate fit with any trailer connectors. All connections including the tell tale monitor connections are now screw type connections. This design eliminates the need for the vehicles wiring to be modified as the system is now housed in the actual trailer connector and acts as an addition to the vehicle instead of a modification. The module is designed to monitor all trailer connections within the plug or a specified number of connections. The main control unit, and tell tale monitor operate the same sequence as the original invention, however it can now be adjusted using a variable or fixed resistor incorporated after the current sensing coil to monitor any required number of trailer lights instead of the unit being set at a fixed current loading. The tell tale monitor, now external, can be mounted on the caravan or trailer and its indicating LED lights and has the same circuit for color combination as in the original invention. The new monitor can bee seen in the drivers rear side view mirror and by any passing person to indicate the electrical safety condition to not only the driver themselves but to any external persons outside the motor vehicle. The addition is a convenient new step in the housing, connections fitment adaptability and visibility of the invented system. A Tell Tale System being part of a trailer connector that is adjustable to any type of trailer lighting combinations that can be used with an external tell tale monitor forms a new age in trailer connections.

DETAILED DESCRIPTION OF THE INVENTION

Figures 1A, 1B:
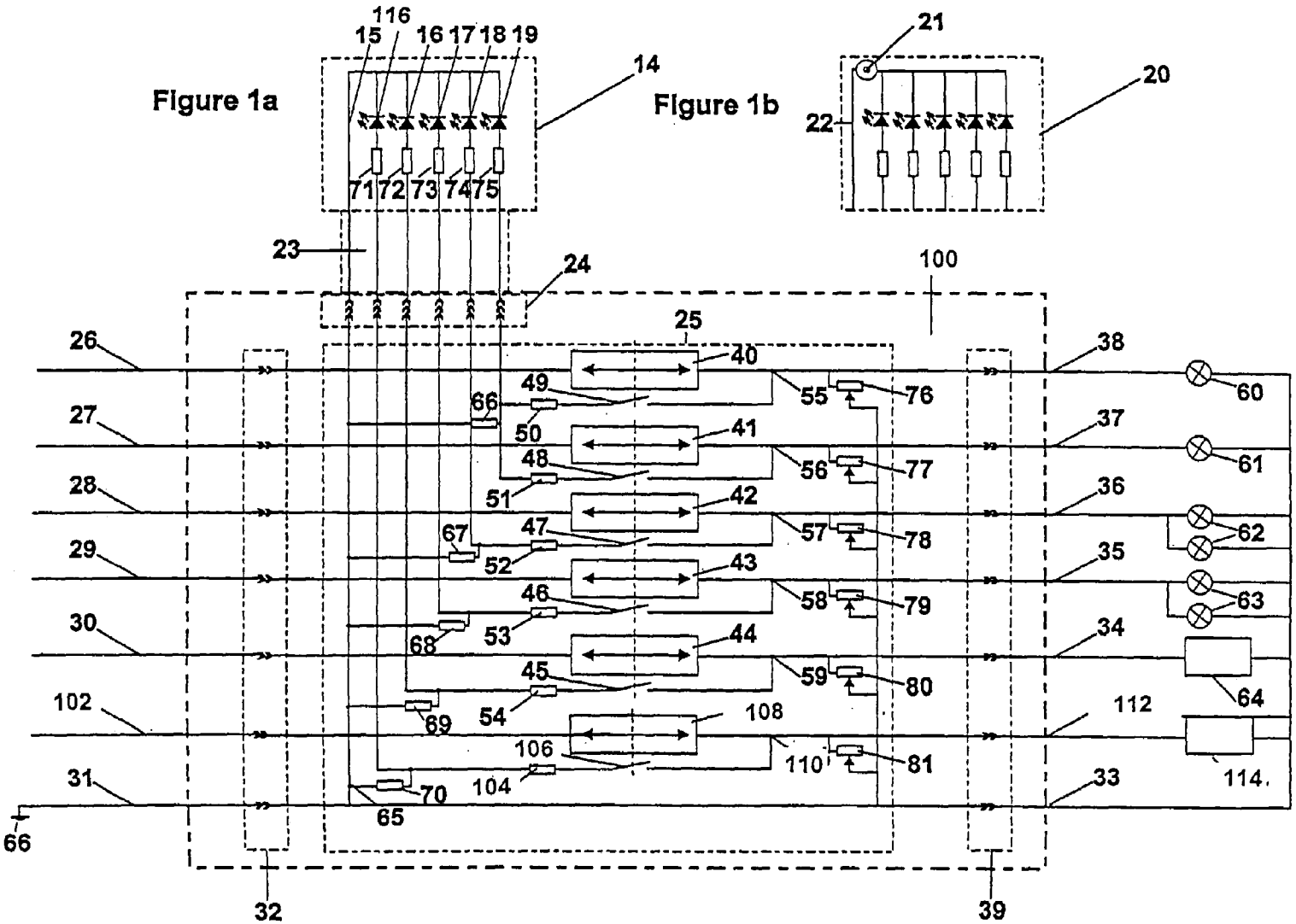
FIG. 1*a* shows the main circuitry of the main invention showing the main addition of the trailer connector housing and how the connections of the main control unit are now enclosed in the trailer connector housing. The additions to the inventions circuitry are also shown, mainly resistor for the adjustable loading capabilities and resistors for LED protection. This figure also shows the capability of the module monitoring all trailer connections within the plug.
FIG. 1*b* shows the additional light emitting diode.

With reference to FIG. 1*a* the original invention circuitry can be seen and its operation is identical to the Australian Patent No. 719780 and U.S. Pat. No. 6,535,113 patented design together with the following additions. The original epoxy casing 25 which is now in the form of an accurate molded module or printed circuit board can be seen in FIGS. 2 to 4. The trailer connector 100 forms the complete housing of the main control unit which encases all connections combining the trailer connector itself and main control unit as one unique device.

Circuits 26 to 60, 27 to 61, 28 to 62, 29 to 63, 30 to 64 and 102 to 114 allow the main control unit module to monitor all connections within the trailer connector. Circuit 102–114 includes current sensing switch 106 for the circuit. Light emitting diode 116 is the tell tale monitor for the circuit 102–114. Again the addition of circuit 102–114 and FIG. 1*b* showing the additional light emitting diode for the additional circuit allows the module to monitor all circuits within the trailer connector. Resistors 66 to 70 are also additional to the original invention. Pull down resistors 66–70 are connected to earth 31. Resistors 66 to 70 protect the light emitting diodes 116 and 16 to 19 in the tell tale monitor 14, from illuminating by any interference from external sources such as moisture or feedback. Resistors 71 to 75 are housed in the tell tale monitor 14 to protect the LEDs 116 and 16 to 19 from high current in the case of circuit malfunction or tampering. Resistors 76 to 81 are either variable or fixed resistors that are placed anywhere in each circuit after the current sensing switches 40, 41, 42, 43, 44 and 45. Resistors 76 to 80 are connected to earth 31 and allow the current sensing switches 40 to 44 and 108 to be adjusted to suit varying currents of trailer loads 60 to 64 and 114. Resistors 76, 77, 78, 79, 80 and 81 can be fitted inside the main control unit 100 or after the connection block 39 and before connections 60, 61, 62, 63, 64 and 114, providing the resistors to be grounded to earth 31.

Figure 2:
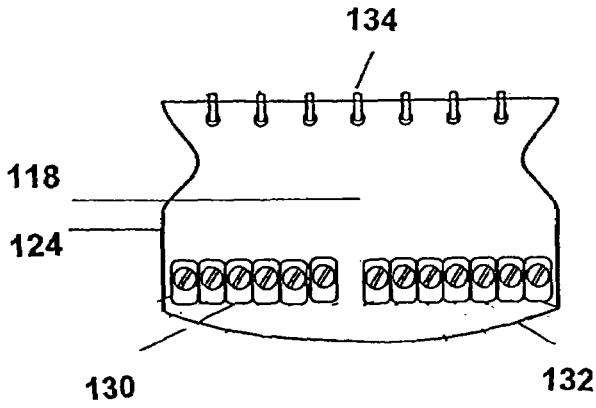
FIG. 2 shows the main control unit module for the common type seven pin flat trailer plug and its main connections.
Figure 3:
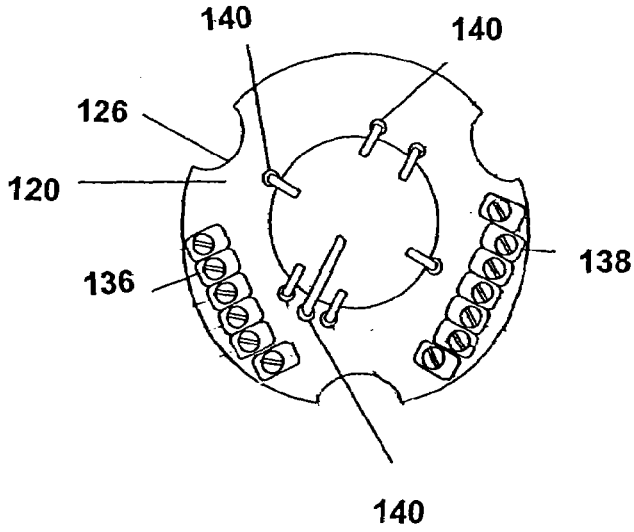
FIG. 3 shows the main control unit module for the common type large seven pin round trailer connector and its connections.
Figure 4:
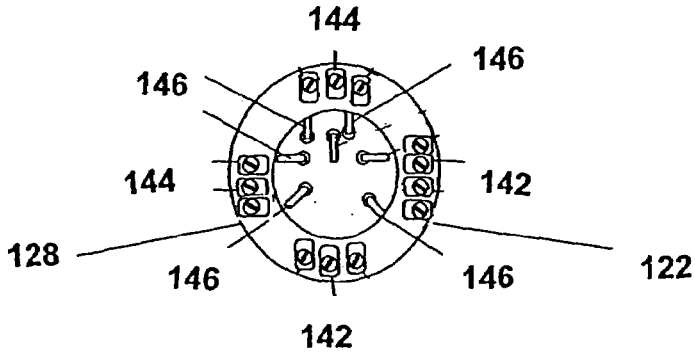
FIG. 4 shows the main control unit module for the common type seven pin round trailer connector and its connections.
Figure 5:
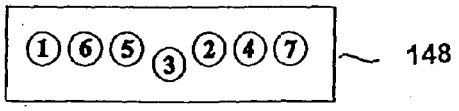
FIG. 5 shows the standard pin positions of the seven pin flat trailer connector.
Figure 6:
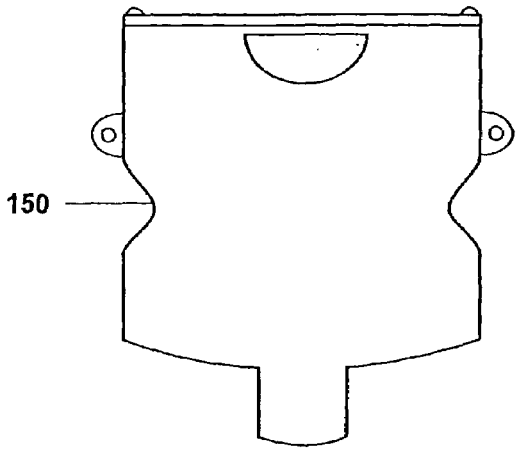
FIG. 6 shows the outline of a standard seven pin flat trailer connector.
Figure 7:
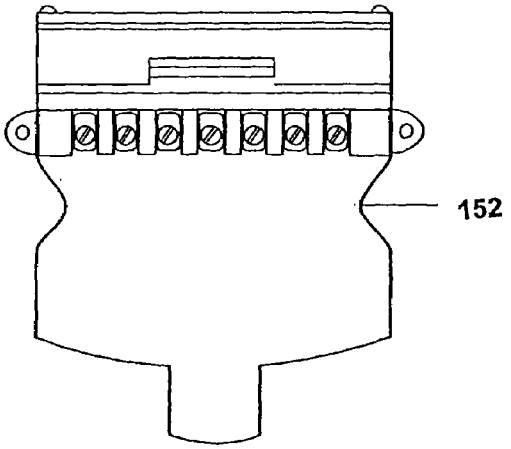
FIG. 7 shows the connection side of the standard seven pin flat trailer connector.
Figure 8:
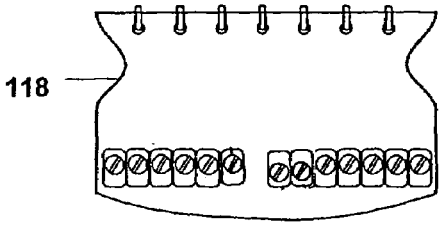
FIG. 8 shows the Main Control Unit Module for the Seven pin flat trailer connector in relation to all other drawings on the page.

FIGS. 2 to 4 show in detail the modules 118, 120 and 122, their distinctive outlines 124, 126 and 128 and their connections 130–134, 136–140 and 142–146 for the three common connector types; however the modules can be adapted to suit any trailer connector available.

The connections 130, 132 and 134 are the connections from the trailer wiring harness into the main control unit. These connections also incorporate the connections for the tell tale monitor. They are of a screw type connector. All connections 130, 132 and 134 incorporate all connections 26 to 31 and all tell tale monitor connections in FIG. 1*a*. Connections 134, 140 and 146 are the main control unit connection to the trailer connector itself. These connections are the same as connections 33 to 38 and 110 of FIG. 1*a*. However the locations of these connections are not relevant to connections 33 to 38 and 110 of FIG. 1*a*. These connections 134, 140 and 146 are connector pins with ferules that can be placed into the connections of the trailer connector and then tightened.

Figure 9:
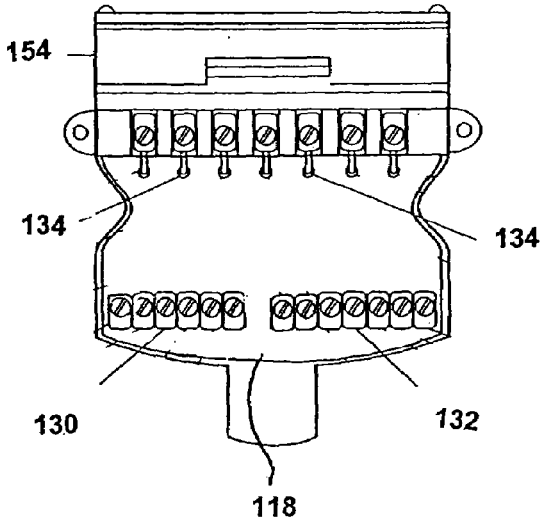
FIG. 9 shows the Main Control Unit Module for the seven pin flat trailer housed in the seven pin flat trailer connector and all of its connections.

FIGS. 5, 6, 7, 8 and 9 describe how the main control unit 118 is mounted into the standard seven pin flat trailer connector 150, connection side 152 and the standard pin position 148. A new generation trailer connector 154 in FIG. 9 shows the main control unit 118 of the Electrical Tell Tale Safety System installed. The main connections 134 of the main control unit modular 118 are connected to the main connections of the trailer connector. These connections are the output for the trailer circuits as in 33 to 38 and 110 of FIG. 1*a*. The connections 130 and 132 A80 to A89 are for all connections from the vehicle to the trailer connector, and also all tell tale monitor connections. It can be seen that the main control unit module 118 fits neatly into the connector 150 and forms one complete unit 154.

Figure 10:
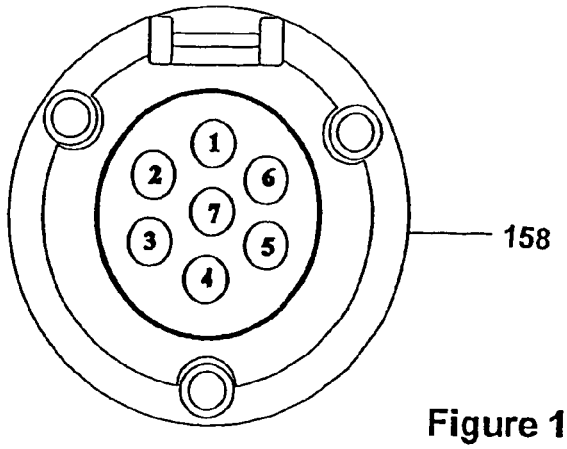
FIG. 10 shows the pin positions for the large seven pin round trailer connector.
Figure 11:
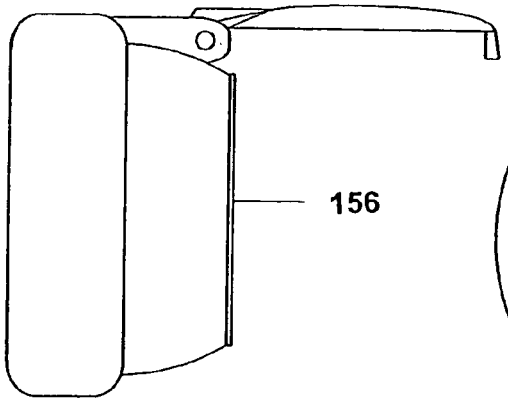
FIG. 11 shows the outline of the large seven pin trailer connector.
Figure 12:
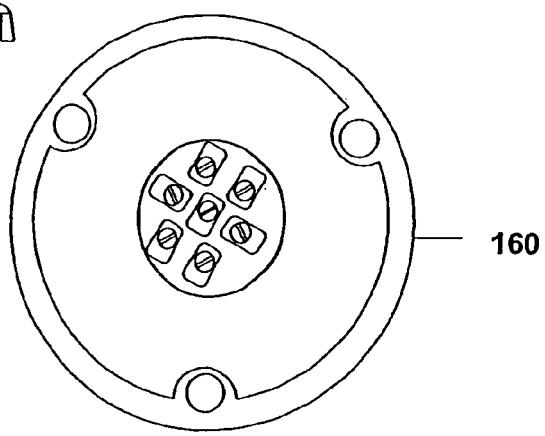
FIG. 12 shows the connection side of the large seven pin trailer connector.
Figure 13:
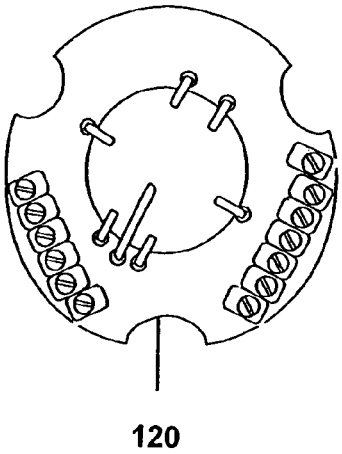
FIG. 13 shows the Main Control unit module for the large seven pin trailer connector in relation to all other drawings on the page.
Figure 14:
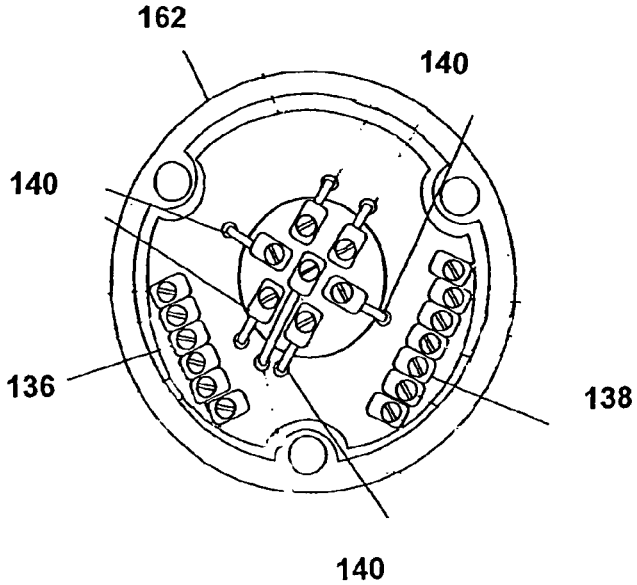
FIG. 14 shows the main control unit for the large seven pin trailer connector housed in the large seven pin trailer connector and all of its connections.
Figure 15:
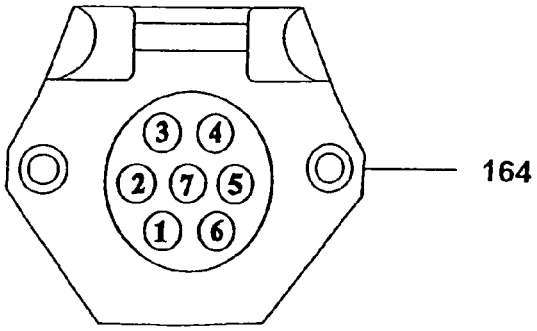
FIG. 15 shows the pin positions of the seven pin trailer connector
Figure 16:
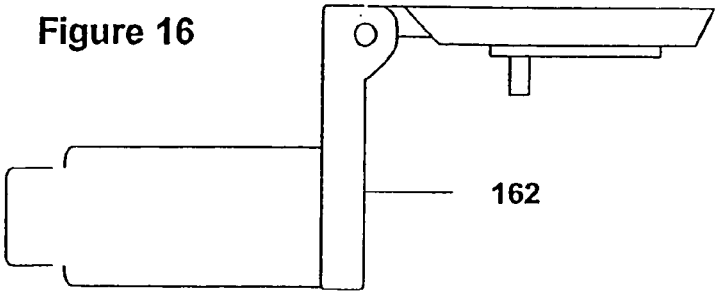
FIG. 16 shows the outline of the seven pin trailer connector.
Figure 17:
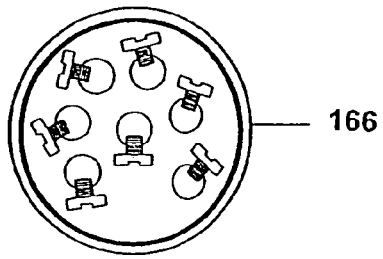
FIG. 17 shows the connection side of the seven pin trailer connector.
Figure 18:
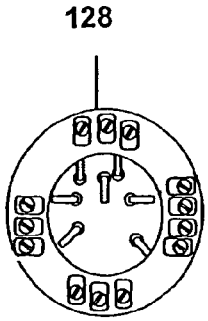
FIG. 18 shows the main control unit module for the seven pin trailer connector with reference to all other drawings on the page.

FIGS. 10 to 14 demonstrate how the main control unit module 120 for the large seven pin round trailer connector 156 is fitted into the connector. The pin positions 158 of the common large seven pin connecter 156 and the connection side 160 where the main control unit 120 is mounted are shown in FIGS. 10 and 12. FIG. 14 shows the complete new generation connector 162 with the main control unit module 120 connected. Connections 138 and 136 are made to the vehicle trailer wiring harness and the tell tale monitor and the connections 140 are the main connection from the main control unit module 120 to the connector itself. These are the output for the trailer circuits when connected. It is again seen the main control unit module 120 is aligned and fits neatly into the connector housing and the connections 140 are accurately positioned.

Figure 19:
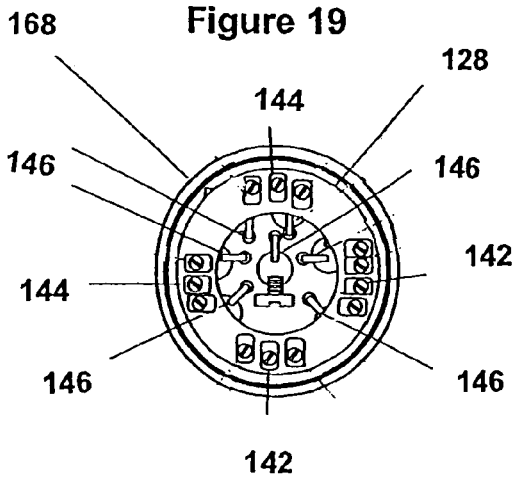
FIG. 19 shows the main control unit for the seven pin trailer connector in the seven pin trailer connector and all of its connections.
Figure 20:
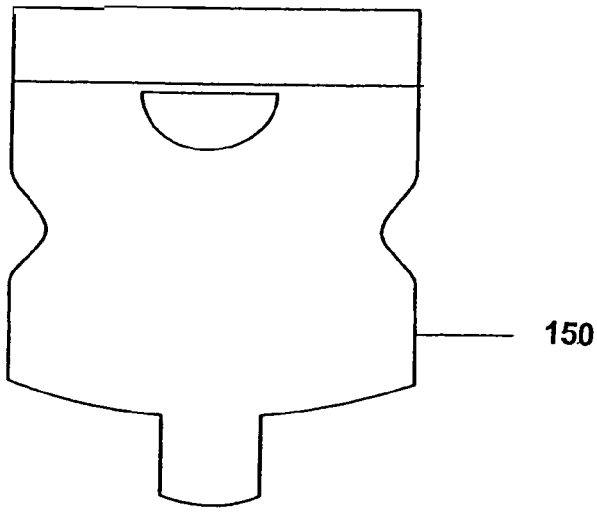
FIG. 20 shows an example of a standard seven pin flat male plug.
Figure 21:
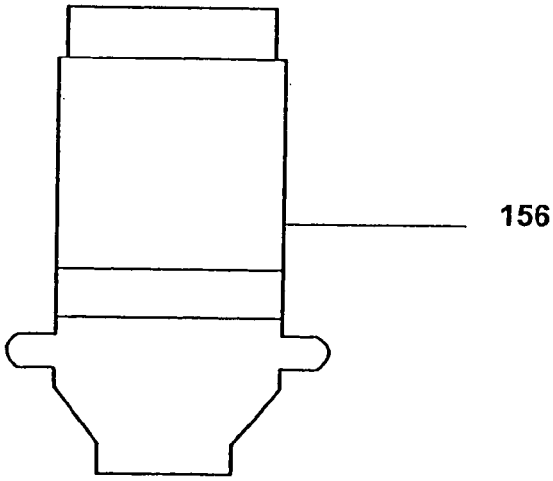
FIG. 21 shows an example of a standard Large Seven Pin round male plug.
Figure 22:
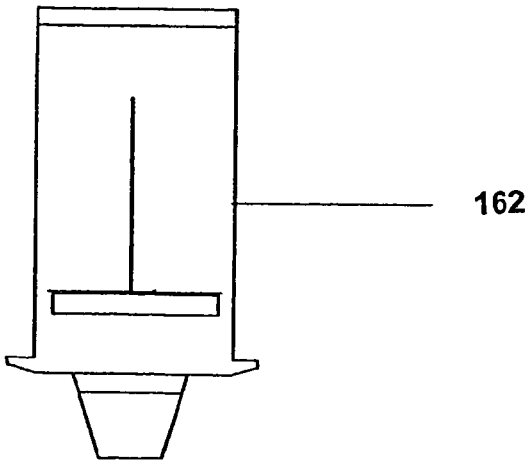
FIG. 22 shows an example of a standard seven pin plug.

FIGS. 15, 16, 17, 18 and 19 are an arrangement similar to the two previous, however this time the main control unit module 128 is housed in a seven pin round trailer connector 162, with pin position 164 and connection side 166. The complete unit 168 with the main control unit module 128 connected and forming part of the connector is shown in FIG. 19. The connections from the vehicle wiring harness and tell tale monitor are of the screw type. The connections 146 from the main control unit 128 to the trailer connector at 166 connect to the trailer circuits.

The main control unit module 128 is aligned neatly to form the new connector 168 and all connection are positioned accurately.

Figure 23:
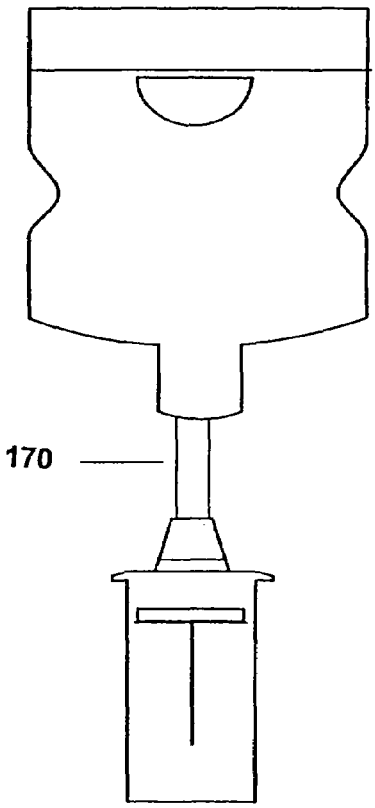
FIG. 23 shows an Example of a Seven pin flat plug to seven pin round plug trailer adapter.
Figure 24:
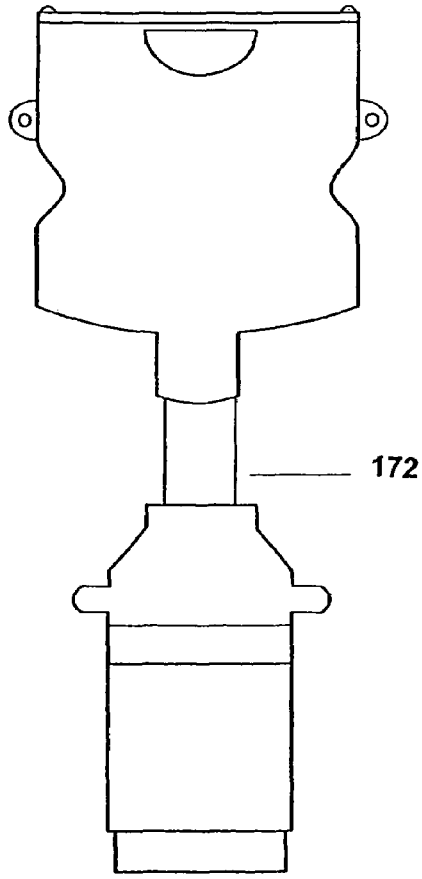
FIG. 24 shows an example of Seven flat trailer connector to a large seven pin plug trailer adapter.
Figure 25:
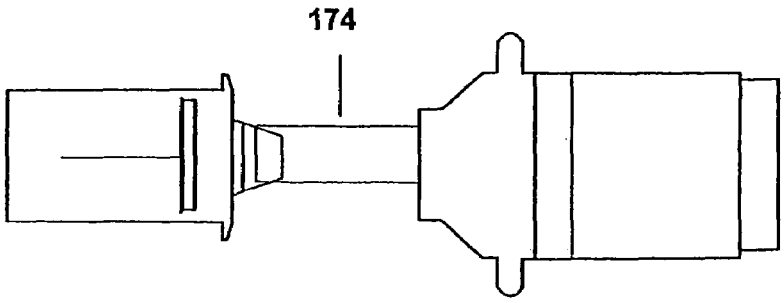
FIG. 25 shows an example of Seven pin plug to large seven pin plug trailer adapter.

The main control units modules in FIGS. 2, 3, and 4 have the ability to be mounted into any designed trailer connector, such as the trailer connector plugs 150, 156 and 162 and form part of it. FIGS. 23, 23 and 25 show adapters 170, 172 and 174. Also the main control unit is able to be monitored in these types of trailer connections.

Figure 26:
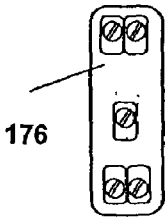
FIG. 26 shows the printed circuit board of the external tell tale monitor.
Figure 27:
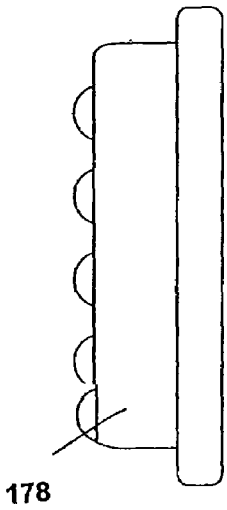
FIG. 27 shows a side view of the new tell tale monitor.
Figure 28:
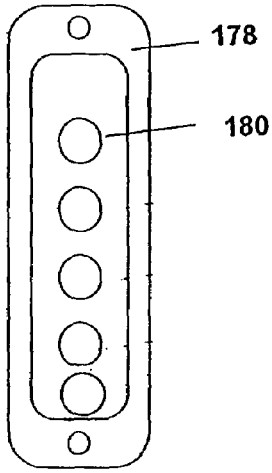
FIG. 28 shows the front view of the tell tale monitor and led lights.

FIG. 26 shows the printed circuit board 176 of the external tell tale monitor 178 shown in FIGS. 27 and 28. This is respective to tell tale monitor 14 in FIG. 1*a*. The printed circuit board 176 is inserted within the tell tale monitor 178. The light emitting diodes 180 are respective to light emitting diodes 116, 16 to 19 in FIG. 1*a*. The light emitting diodes 180 are different colored respective of each circuit in the original invention. The order of the circuit/LED combination on the tell tale monitor 178 can be in any order. The colors of LED lights 180 may be red for brake light circuit, green for turn indicator circuit, amber for clearance light circuit and blue for electric brake circuit.

Figure 29:
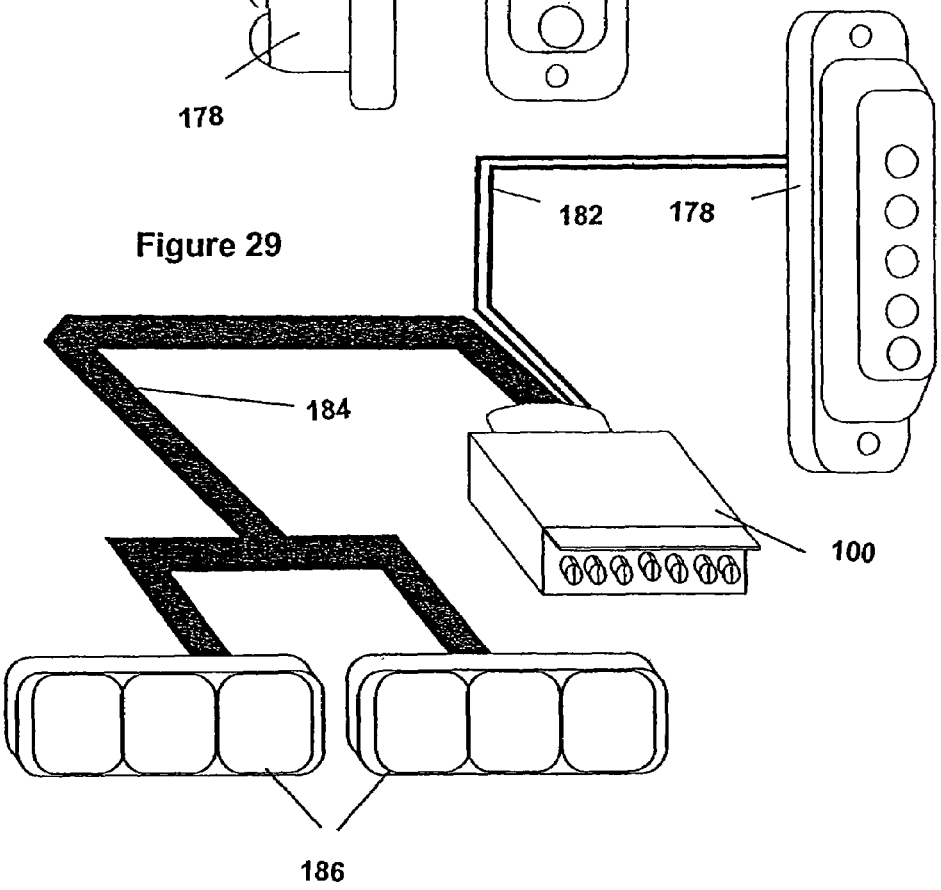
FIG. 29 shows the complete system and connections.

FIG. 29 shows the invention completely connected, the main control unit 100 housing the main electronics as in FIG. 1*a*. This is connected to a modular cable 182 respective of cable 23 in FIG. 1*a*. The other end of cable 182 is connected to the PCB 176, which is housed in the external tell tale monitor 178. From the main control unit 100, a seven core cable 184 is connected. The cable 184 carries all wires 33 to 38 and 110 in FIG. 1*a*. The opposite end of the cable 184 is connected to the trailer lights 186, which are lights 60 to 63 in FIG. 1*a*. All wire connections within the tell tale monitor 178 and the control unit 100 are screw type onto the PCB as shown in FIG. 2 to FIG. 4.

Figure 30:
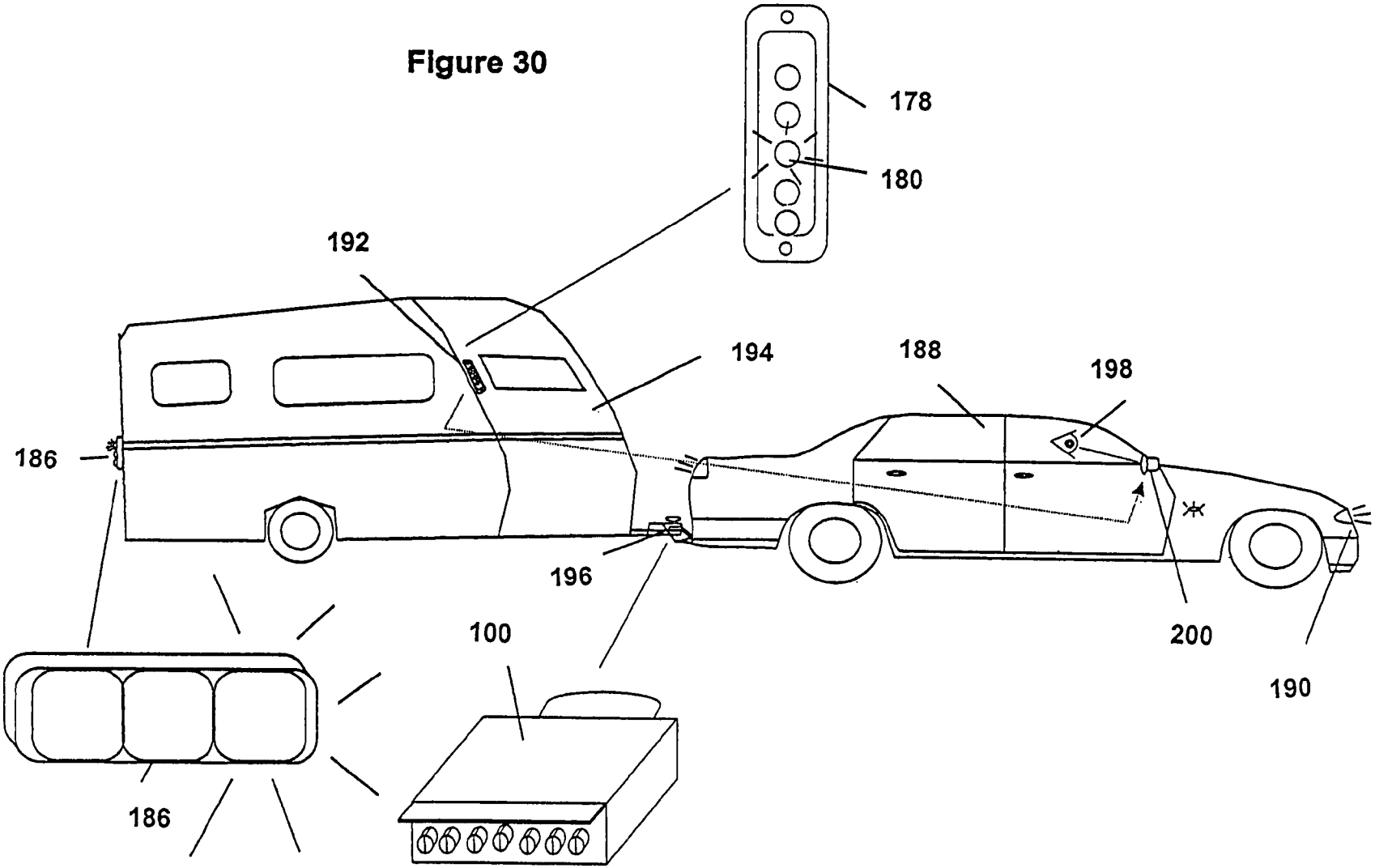
FIG. 30 shows the complete system installed on a vehicle and operating.

FIG. 30 shows the positioning of the main components and the operation on the vehicle. The vehicle 188 has its right indicator 190 on. Normally this causes the appropriate trailer lamp 186 to flash providing they are working correctly. The external monitor 178 is fitted at point 192 on the caravan 194. The main control unit 100 is fitted at point 196 to replace a normal trailer connector. Main control unit 100 can either be a male or female plug. The driver 198 can see that the light is working on the caravan 194 by looking at the tell tale monitor 178 in the rear view mirror 200. The tell tale monitor 178 illuminates to indicate that that circuit is functioning correctly. It achieves this by the circuitry of FIG. 1*a*, which is housed inside the connector on PCBs as in FIG. 2 to FIG. 4. In the case of the trailer lights not operating, the appropriate LED 180 would not work and the driver would see no illumination from the LED indicating that the trailer light is malfunctioning. This is achieved by the circuitry shown in FIG. 1*a*.

In all cases the main control unit module is able to be mounted into any existing and yet to be manufactured trailer connector by its specific molded designed and aligned connector pins, forming part of the connector/adapter itself. Together with the external tell tale monitor as described, this system changes the normal plugs operation to a complete unit that is able to monitor the condition of all of the connections and circuits of the trailer connector itself, this in turn forming a new generation trailer connector in the interests of road safety.

I claim:

1. A trailer, comprising:

a) electrical circuits carried by said trailer;

b) said circuits terminate in an electrical connector for connecting to a trailer wiring of a hauling vehicle when said trailer is to be towed, said connector having a housing;

c) a plurality of current sensors for monitoring the trailer circuits;

d) a monitor connected to said sensors to indicate that said circuits are operating normally when said current sensors sense current; and e) said monitor is mounted on a part of said trailer visible from a rear view mirror of said vehicle.

2. A trailer as in claim 1, wherein said sensors are disposed within said housing.

3. An electrical tell tale system as in claim 1, and further comprising a plurality of adjustable resistors operably connected to each sensor to accommodate for differing trailer circuit current loads.

4. An electrical tell tale system as in claim 1, wherein said monitor includes a number color coded LEDs, each LED being associated with a respective current sensor.

5. An electrical tell tale system as in claim 4, and further comprising a plurality of resistors, each connected across a respective LED.

* * * * *